US008402720B2

(12) United States Patent
Boldrini et al.

(10) Patent No.: US 8,402,720 B2
(45) Date of Patent: Mar. 26, 2013

(54) MACHINE FOR MANUFACTURING POUCHES CONTAINING A TOBACCO MIXTURE

(75) Inventors: Fulvio Boldrini, Ferrara (IT); Roberto Ghiotti, Calderino di Monte San Pietro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 335 days.

(21) Appl. No.: 12/679,598

(22) PCT Filed: Oct. 9, 2008

(86) PCT No.: PCT/IB2008/002768

§ 371 (c)(1),
(2), (4) Date: Mar. 23, 2010

(87) PCT Pub. No.: WO2009/047627

PCT Pub. Date: Apr. 16, 2009

(65) Prior Publication Data

US 2010/0199601 A1 Aug. 12, 2010

(30) Foreign Application Priority Data

Oct. 12, 2007 (IT) ..... BO2007A0688

(51) Int. Cl.

| | |
|---|---|
| ***B65B 9/06*** | (2006.01) |
| ***B65B 37/12*** | (2006.01) |
| ***B65B 37/14*** | (2006.01) |
| ***B65B 37/16*** | (2006.01) |
| ***B65B 39/00*** | (2006.01) |

(52) U.S. Cl. ..... 53/111 R; 53/431; 53/530; 53/550; 53/568

(58) Field of Classification Search ..... 53/104, 53/105, 148, 431, 111 R, 113, 523, 525, 530, 53/550, 568; *B65B 9/06, 37/12, 37/14, 37/16, B65B 39/00*

See application file for complete search history.

(56) References Cited

U.S. PATENT DOCUMENTS

| | | | | | |
|---|---|---|---|---|---|
| 3,585,774 | A | * | 6/1971 | Rowell et al. | 53/523 |
| 3,923,084 | A | * | 12/1975 | Matthews et al. | 53/570 |
| 4,607,479 | A | * | 8/1986 | Linden | 53/530 |
| 4,703,765 | A | * | 11/1987 | Paules et al. | 131/112 |
| 5,113,635 | A | * | 5/1992 | Takai et al. | 53/530 |
| 5,174,088 | A | | 12/1992 | Focke | |
| 5,299,583 | A | * | 4/1994 | Lasch et al. | 131/312 |

(Continued)

FOREIGN PATENT DOCUMENTS

WO 9808738 3/1998

OTHER PUBLICATIONS

International Search Report dated Mar. 9, 2009 from counterpart PCT patent application, PCT/IB2008/002768, 3 pages.

*Primary Examiner* — Stephen F Gerrity

(74) *Attorney, Agent, or Firm* — Timothy J. Klima; Shuttleworth & Ingersoll, PLC

(57) ABSTRACT

In a machine (1) for manufacturing pouches (2) filled with portions (36) of a tobacco mixture, comprising a rotating drum (8) on which a continuous stream (5) of the mixture is formed and conveyed to a station (13) where the portions (36) are divided from the stream, and where the portions (36) are transferred by a pneumatic ejection and feed system (21) to a wrapping station (7), moisturizing substances are added to the mixture by a dispensing system (22) associated with the ejection and feed system (21).

7 Claims, 5 Drawing Sheets

U.S. PATENT DOCUMENTS 5,511,566 A * 4/1996 Brand ..... 131/109.3
6,135,120 A * 10/2000 Lofman et al. ..... 53/111 R
7,866,127 B2 * 1/2011 Ancona et al. ..... 53/473
2010/0101588 A1 * 4/2010 Boldrini et al. ..... 131/58

* cited by examiner

MACHINE FOR MANUFACTURING POUCHES CONTAINING A TOBACCO MIXTURE

CROSS-REFERENCE TO RELATED APPLICATIONS

This application is the National Phase of International Application PCT/IB2008/002768 filed Oct. 9, 2008 which designated the U.S. and that International Application was published under PCT Article 21(2) in English.

This application claims priority to Italian Patent Application No. B02007A000688 filed Oct. 12, 2007, and PCT Application No. PCT/IB2008/002768 filed Oct. 9, 2008, which applications are incorporated by reference herein.

TECHNICAL FIELD

The present invention relates to a machine for manufacturing pouches containing a tobacco mixture, in particular for oral use (a product also known by the name of snus).

Besides tobacco, such mixtures typically contain oily substances serving as moisturizers (honey or molasses), and essences of flowers or fruit as aromatic agents.

BACKGROUND ART

As regards the production of snus pouches, the prior art embraces a machine comprising a hopper filled with the tobacco mixture, and rotary conveyor means to which the mixture is released from an outlet of the hopper.

Rotary conveyor means consist in a disc centred on a vertical axis and furnished with peripheral cavities, each containing a portion of tobacco mixture corresponding to the contents of a single pouch.

The single portions are carried by the disc toward an exit or transfer station where they are ejected and thereupon directed along a rectilinear feed duct to a wrapping station; here, the portions of tobacco mixture are packaged in respective pouches.

Alternatively, the conveyor means can take the form of a drum rotatable intermittently about a horizontal axis, on which a continuous stream of tobacco mixture is formed and transported to an exit or transfer station where segments of the stream, corresponding to single portions, are directed into and along the aforementioned rectilinear feed duct to the wrapping station where they are packaged in respective pouches.

The outer surface of the rotating drum presents an annular groove, connected to suction means and accommodating the continuous stream, which is released at the aforementioned transfer station segment by successive segment, each corresponding to a single portion.

In both of the cases described, the transfer of the mixture at the relative station is brought about by pneumatic ejection means, which operate by producing a jet of air such as will distance the portions singly and in succession and feed them along the rectilinear duct.

The duct comprises a funnelform mouth and a rectilinear cylindrical portion.

The wrapping station comprises a tubular mandrel, placed at the outlet end of the rectilinear cylindrical portion, over which a continuous web of wrapping material is formed into a tubular envelope such as can be sealed longitudinally and transversely and then cut, all by conventional methods, so as to obtain a continuous succession of pouches containing the aforementioned portions of tobacco mixture.

It has been found that mixtures adopted for tobacco products of the type in question, by reason of their particular composition, tend to stick and solidify on the various processing and conveying elements of the machine, with the result that frequent servicing is required.

This is a drawback that can bring the machine ultimately to a standstill, and occurs in particular at the restriction presented by the funnelform mouth of the feed duct.

The likelihood of clogging in the duct is increased by the action of the aforementioned pneumatic ejection means, which has the effect of reducing the moisture content of the mixture and causing deposits of the material to dry and harden, so that cleaning operations are made more difficult.

DISCLOSURE OF THE INVENTION

The object of the present invention, accordingly, is to overcome the drawbacks described above.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
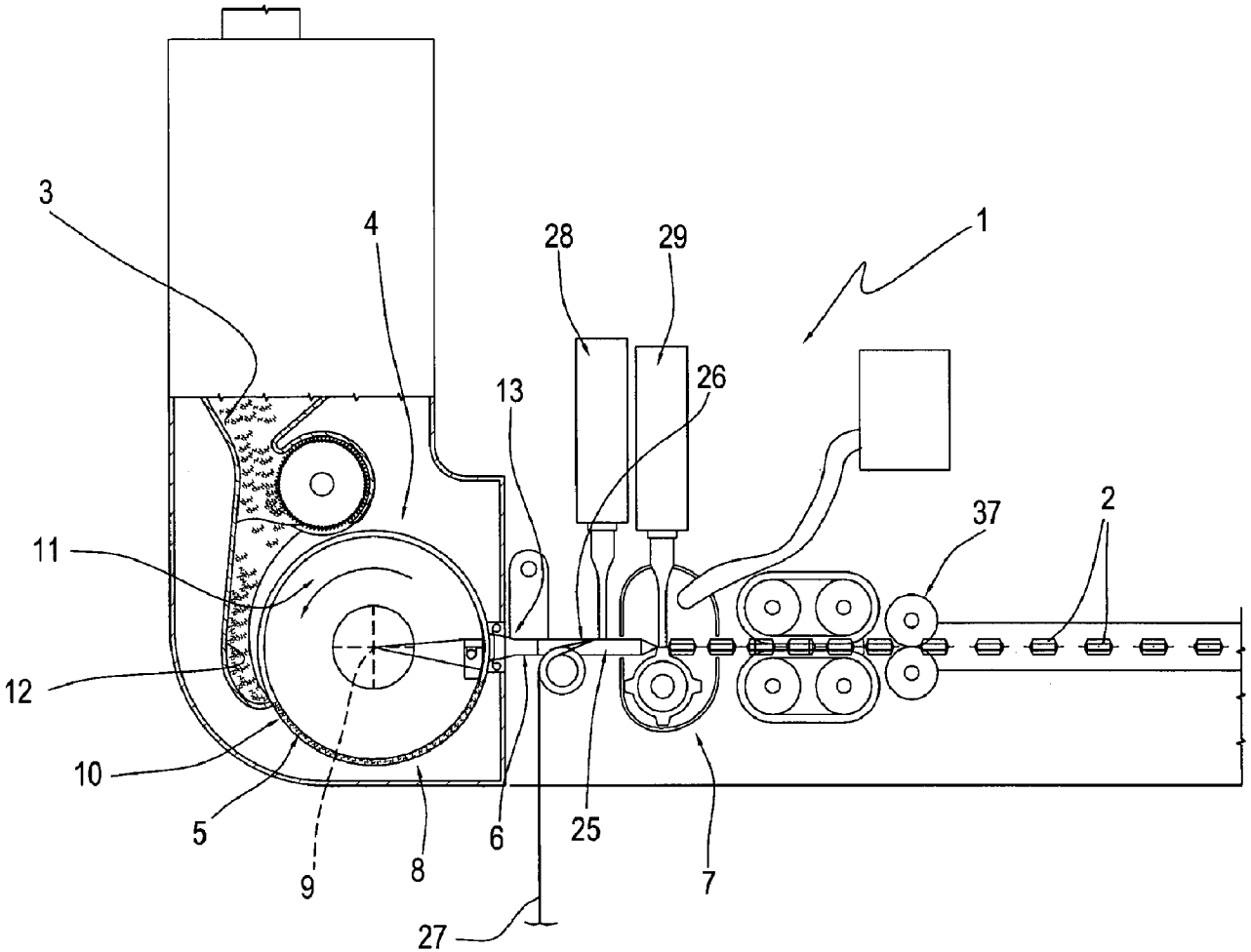
FIG. 1 illustrates a machine according to the present invention for manufacturing pouches of tobacco mixture, viewed schematically in a front elevation.
Figure 2:
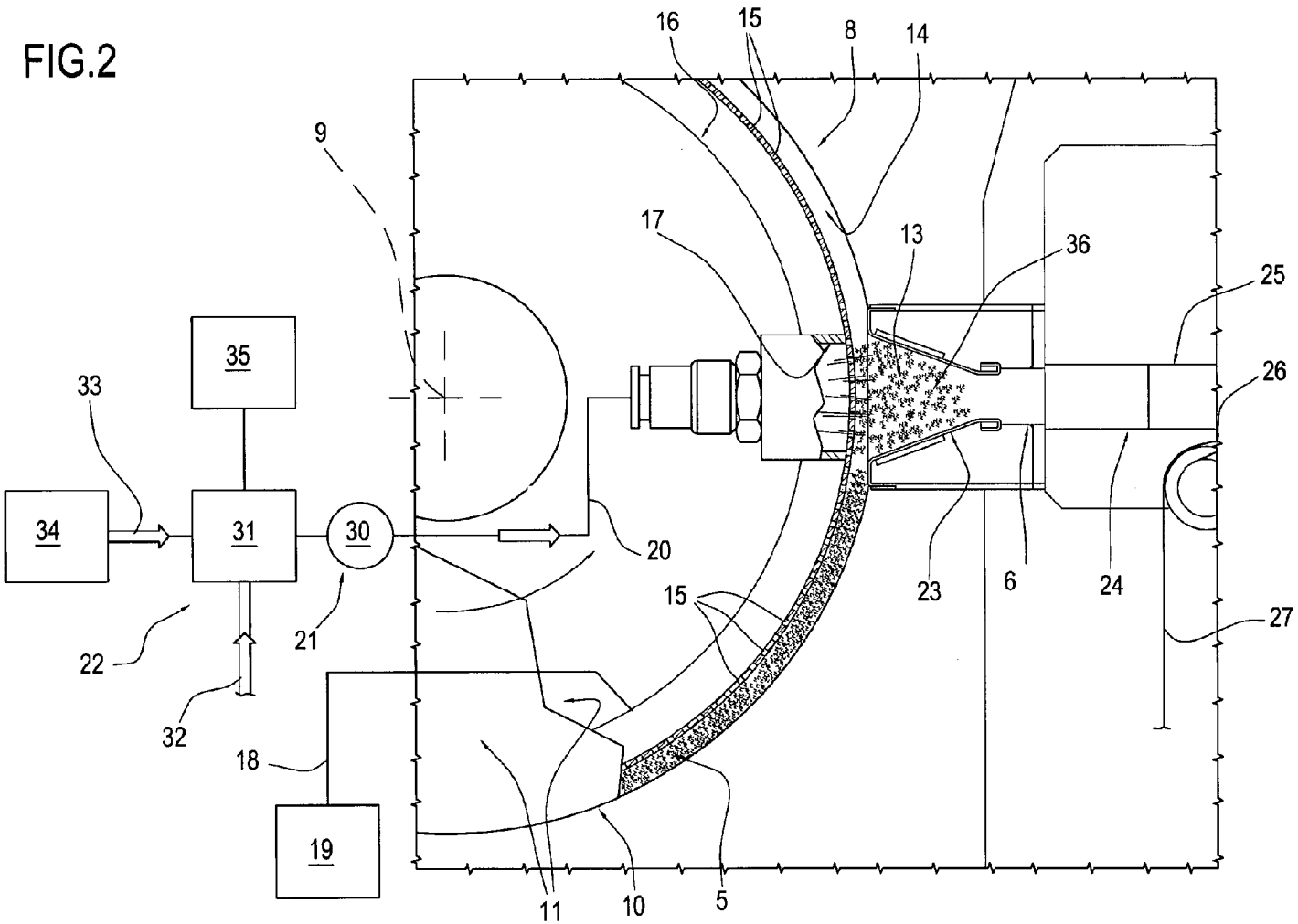
FIG. 2 shows an enlarged detail of FIG. 1.

With reference to FIGS. 1 and 2, numeral 1 denotes a machine used in the manufacture of pouches 2 containing a tobacco mixture for oral use.

The machine 1 comprises a hopper 3 serving as means of storing and feeding the tobacco mixture, connected by way of conveyor means 4 on which to form a continuous stream 5 of the mixture, and by a rectilinear duct 6, to a wrapping station 7 where the pouches 2 are fashioned.

More exactly, such conveyor means 4 comprise a drum 8 rotatable about a horizontal axis 9, presenting a cylindrical wall 10 and enclosed by two mutually opposed side walls 11 (one only of which is visible in FIG. 1).

The drum 8 rotates intermittently about the axis 9 in an anticlockwise direction, as viewed in the drawings, through steps of predetermined angular distance, and is interposed between a bottom outlet end 12 of the hopper 3 and a portioning or transfer station 13 positioned substantially at 270° from an infeed station coinciding with the hopper outlet.

The cylindrical wall 10 of the drum 8 presents an annular groove 14 of predetermined width, pierced along its entire circumferential length by through holes 15 communicating with an internal annular chamber divided into a first sector 16 and a second sector 17.

The second sector 17, which extends through an arc of predetermined width, is sandwiched between the two ends of the first sector 16 and positioned to coincide with the transfer station 13.

The first sector 16 is connected by way of a duct 18 to a source of negative pressure indicated schematically as a block, denoted 19.

The second sector 17 in turn is connected via a further duct 20 to pneumatic ejection and feed means 21, by which segments of the stream 5 are separated from the drum, and to dispensing means denoted 22 in their entirety, from which moisturizing substances are delivered.

The rectilinear feed duct 6 comprises an inlet portion or mouth 23 of funnelform appearance, facing the sector of the drum coinciding with the transfer station 13, and a tubular body 24.

Numeral 25 denotes a tubular mandrel, connected to and aligned coaxially with the outlet of the tubular body 24, around which a tubular envelope 26 of paper wrapping material 27 (decoiling from a roll, not illustrated) is fashioned through the agency of conventional folding means (not illustrated).

The tubular envelope 26 is sealed longitudinally by first sealing means 28 operating in close proximity to the tubular mandrel 25.

The envelope 26 is also sealed transversely by second sealing means 29 operating downstream of the tubular mandrel 25.

As illustrated in FIG. 2, the pneumatic ejection and feed means 21 are composed of a pump 30, generating an intermittent flow of air delivered by the aforementioned means 22 from which moisturizing substances are dispensed; such means 22 comprise a mixing chamber 31 provided with an air inlet 32, and a further inlet connected to the outlet duct 33 of a reservoir 34 containing vaporized water or other moisturizing substances. Also forming part of the dispensing means 22 is a control unit 35, connected to the mixing chamber 31, which serves to regulate the level of moisture in the flow generated by the pump 30 according to the type of material making up the tobacco mixture and/or the operating speed of the machine 1.

In operation, with the drum 8 rotating intermittently, tobacco mixture is collected and formed gradually into a continuous stream 5 within the aspirating annular groove 14.

The continuous stream 5 advances into the transfer station 13 where, with each step indexed by the drum 8, a jet of compressed air moisturized with the substances delivered by the dispensing means 22 is expelled from the second sector 17 through the relative holes 15, causing a segment of the stream 5 to be ejected from the groove and directed through the funnelform mouth 23 into the tubular body 24 of the rectilinear feed duct 6. The ejected segment is of predetermined length corresponding to a single wrappable portion 36.

Emerging from the rectilinear duct 6, the portion 36 of tobacco mixture passes along the tubular mandrel 25, around which the aforementioned tubular envelope 26 of wrapping material is fashioned progressively by a conventional forming method.

The tubular envelope 26 is closed up longitudinally by the first sealing means 28.

On leaving the tubular mandrel 25, the tubular envelope 26 containing the successive portions 36 of tobacco mixture is engaged transversely by the second sealing means 29, operating intermittently and timed to match the frequency with which the portions 36 are ejected, in such a way that each portion will be enclosed between two successive transverse seals.

As a result of these operations, a continuous succession of tobacco-filled pouches 2 will emerge, connected one to the next by way of the transverse seals. Downstream of the transverse sealing means 29, the single pouches 2 are separated one from the next by cutting means 37.

The addition of a moisturizing substance eases the passage of the portions 36 of tobacco mixture along the rectilinear duct 6, preventing the formation of deposits and the risk of clogging, especially at the restriction presented by the funnelform mouth 23.

Figure 3:
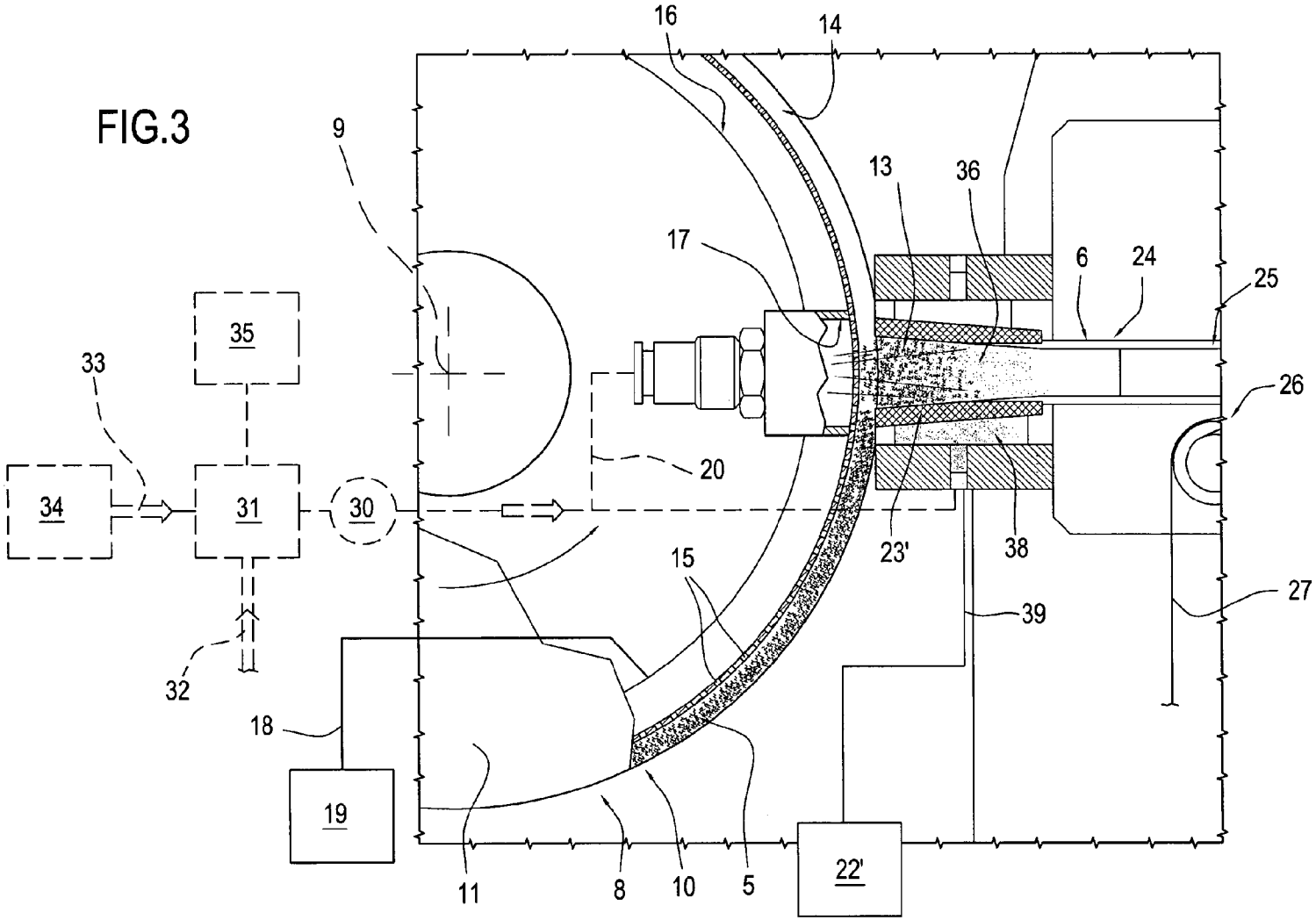
FIG. 3, FIG. 4 and FIG. 5 show the detail of FIG. 2 in a second, a third and a fourth embodiment, respectively.

As illustrated in the example of FIG. 3, the moisturizing substance can be also be added directly to the tobacco mixture inside the funnelform mouth of the rectilinear duct 6, either as well as or instead of being entrained in the air jet as described above.

In this instance the funnelform mouth, denoted 23', is fashioned from a porous material and housed within an annular chamber 38 connected by way of a duct 39 to the pump 30, or to other means 22' of dispensing the moisturizing substance.

Figure 4:
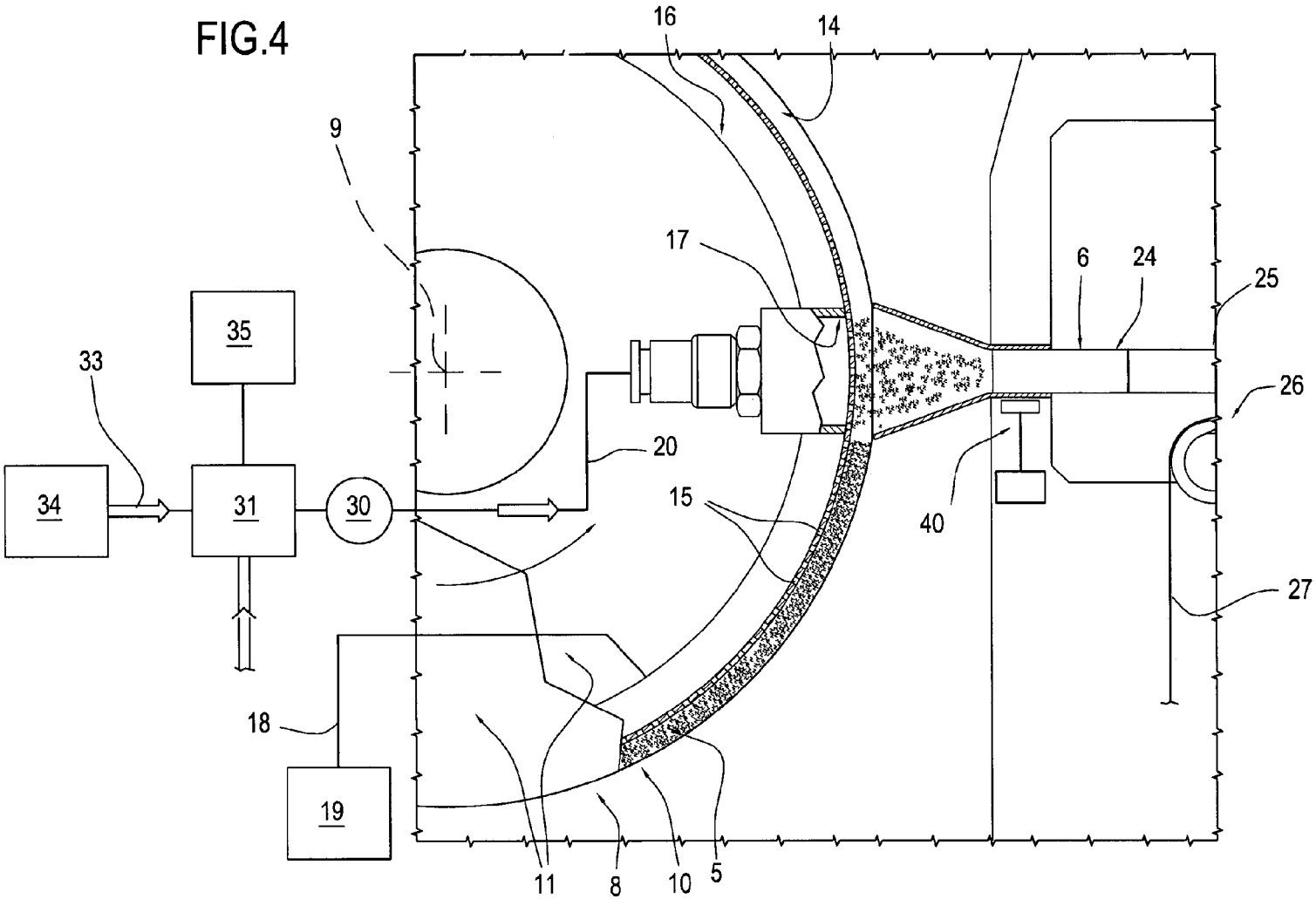

In the example of FIG. 4, the machine is equipped with a vibrator device 40 connected to the funnelform mouth 23 of the feed duct.

The action of this device, combined with that of the moisturizing substance, is particularly effective in ensuring that deposits of the tobacco mixture do not form at the entry point of the rectilinear feed duct 6.

Figure 5:
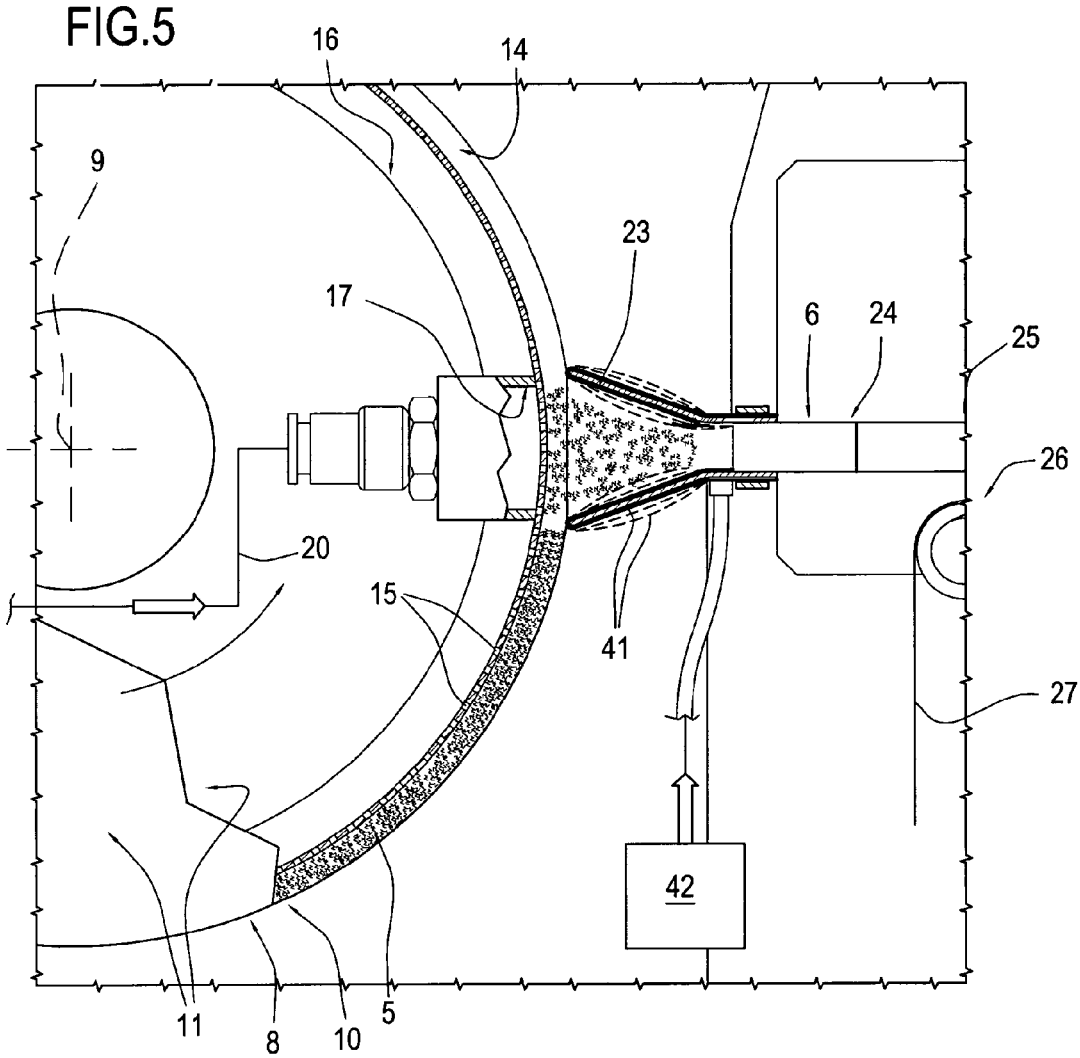
Figure 6:
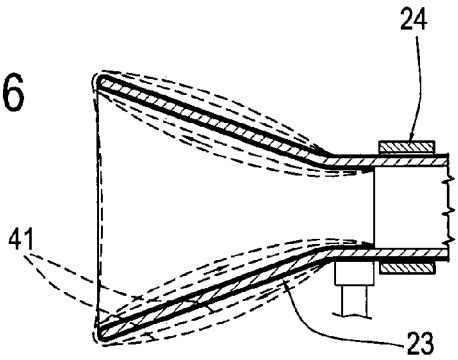
FIG. 6 shows an enlarged detail of FIG. 5.

With reference to the embodiment illustrated in FIGS. 5 and 6, the funnelform mouth 23 is covered both internally and externally by a tubular element or sheath 41 of elastic material, secured by a first end to an external face presented by the inlet end of the tubular body 24, looped over the inlet rim of the mouth 23, and secured by the second end to an internal face presented by the inlet end of the tubular body 24.

The space delimited between the sheath 41 and the flared surfaces of the mouth 23 is connected to a source of pulsed compressed air, denoted 42, of which the action produces a vibratory effect on the mouth 23 of the rectilinear feed duct 6 similar to that of the device described previously.

What is claimed is:

1. A machine for manufacturing pouches containing a tobacco mixture, comprising:

a conveyor mechanism by which the mixture is carried to a transfer station, an ejection and feed mechanism operating at the transfer station, by which portions of the mixture are directed from the conveyor mechanism through a duct toward a wrapping station at which the portions are sealed in pouches, a dispensing mechanism delivering moisturizing substances by which the tobacco mixture is moisturized, wherein the conveyor mechanism carrying the tobacco mixture includes a rotating drum on which a continuous stream of the mixture is formed and directed toward the transfer station, the ejection and feed mechanism being of pneumatic type and constructed and arranged to separate the stream from the drum by segments, each corresponding in quantity to a single wrappable portion, the dispensing mechanism dispensing the moisturizing substances being associated with the ejection and feed mechanism.

2. A machine as in claim 1, wherein the ejection and feed mechanism comprises a pump supplying an intermittent flow of air to the transfer station, and the dispensing mechanism comprises a reservoir containing a supply of moisturizing substances, connected to the pump by way of a mixing chamber.

3. A machine as in claim 2, wherein the dispensing mechanism comprises a control unit for regulating a level of moisture in the air flow supplied by the pump according to at least one of a type of material making up the tobacco mixture and an operating speed of the machine.

4. A machine as in claim 3, wherein the duct is rectilinear and comprises a funnelform mouth fashioned from a porous material, housed internally of a chamber connected to the dispensing mechanism by which the moisturizing substances are delivered.

5. A machine as in claim 4, comprising a vibrator device associated with the mouth of the rectilinear duct.

6. A machine as in claim 1, wherein an inlet portion of the duct is of funnelform embodiment and covered by a sheath in which vibratory motion is induced through use of a source of compressed air.

7. A machine as in claim 1, comprising a vibrator device associated with at least one of an inlet portion and a mouth of the duct.

* * * * *